US012420978B2

(12) United States Patent
Turner

(10) Patent No.: US 12,420,978 B2
(45) Date of Patent: Sep. 23, 2025

(54) BLANK AND BOX OBTAINABLE THEREFROM

(71) Applicant: DS SMITH PLC, London (GB)

(72) Inventor: Russell Turner, Monmouth (GB)

(73) Assignee: DS SMITH PLC, London (GB)

( * ) Notice: Subject to any disclaimer, the term of this patent is extended or adjusted under 35 U.S.C. 154(b) by 0 days.

(21) Appl. No.: 17/926,797

(22) PCT Filed: May 19, 2021

(86) PCT No.: PCT/EP2021/063254
§ 371 (c)(1),
(2) Date: Nov. 21, 2022

(87) PCT Pub. No.: WO2021/233978
PCT Pub. Date: Nov. 25, 2021

(65) Prior Publication Data

US 2023/0202706 A1 Jun. 29, 2023

(30) Foreign Application Priority Data

May 21, 2020 (GB) ..... 2007593

(51) Int. Cl.
*B65D 5/44* (2006.01)
*B65D 5/54* (2006.01)

(52) U.S. Cl.
CPC ..... *B65D 5/445* (2013.01); *B65D 5/5435* (2013.01); *B65D 5/5445* (2013.01)

(58) Field of Classification Search
CPC .... B65D 5/445; B65D 5/5435; B65D 5/5445; B65D 5/0227; B65D 5/28; B65D 5/02;
(Continued)

(56) References Cited

U.S. PATENT DOCUMENTS 1,850,164 A 3/1932 Andrews
2,933,228 A * 4/1960 Reynolds ..... B65D 5/0227 229/199

(Continued)

FOREIGN PATENT DOCUMENTS

CN 209177087 U * 7/2019
CN 112389800 A * 2/2021

(Continued)

OTHER PUBLICATIONS

International Search Report and Written Opinion for International Patent Application No. PCT/EP2021/063254, mailed Jun. 17, 2021, 9 pages.

*Primary Examiner* — Christopher R Demeree
(74) *Attorney, Agent, or Firm* — Armstrong Teasdale LLP

(57) ABSTRACT

A blank is provided which has a chassis of corrugated cardboard where a series of a quadrangular closure flap, a quadrangular cover panel, a first quadrangular lateral panel, a quadrangular bottom panel and a second quadrangular lateral panel are individuated by crease lines. Each panel is provided with left and right quadrangular flaps, respectively. The blank has four compression members of corrugated cardboard glued to an internal face of the chassis in correspondence of areas bordering the first and second quadrangular panels and the respective left and right quadrangular flaps. A box obtainable from the blank by folding is also provided.

12 Claims, 6 Drawing Sheets

(58) Field of Classification Search
CPC ... B65D 5/42; B65D 5/44; B65D 5/54; B65D 5/5033; B65D 5/56; B65D 5/0025; B65D 5/441
USPC ..... 229/199, 122.32, 918, 132, 919, 198.1, 229/198.2; 206/521; 220/642, 652
See application file for complete search history.

(56) References Cited

U.S. PATENT DOCUMENTS

| | | | | | |
|---|---|---|---|---|---|
| 4,059,220 | A * | 11/1977 | Lorenz | B65D 5/22 229/199 |
| 4,341,338 | A * | 7/1982 | Arnold | B65D 5/443 229/199 |
| 5,887,782 | A * | 3/1999 | Mueller | B65D 5/4608 229/199 |
| 10,399,733 | B2 * | 9/2019 | Grigsby | B65D 5/0281 |
| 10,583,955 | B2 * | 3/2020 | Ackroyd | B65D 5/103 |
| 10,633,141 | B2 * | 4/2020 | Novotny | B65D 5/443 |
| 10,661,941 | B2 * | 5/2020 | Genender | B65D 5/443 |

FOREIGN PATENT DOCUMENTS

| | | | | |
|---|---|---|---|---|
| EP | 2000294 | A2 | 12/2008 | |
| ES | 2614996 | T3 * | 6/2017 | B65D 5/5033 |
| GB | 2160506 | A | 12/1985 | |
| GB | 2565290 | A | 2/2019 | |

* cited by examiner

BLANK AND BOX OBTAINABLE THEREFROM

CROSS-REFERENCE TO RELATED APPLICATIONS

This application is a National Stage Application of International Patent Application No. PCT/EP2021/063254, having an International Filing Date of May 19, 2021, which claims priority to British Patent Application No. 2007593.3, filed May 21, 2020, the entire contents of each of which are incorporated by reference herein.

FIELD OF THE INVENTION

The present invention relates to a blank of corrugated cardboard, and the box obtained from folding such a blank.

BACKGROUND OF THE INVENTION

As it is known, corrugated cardboard is composed of a fluted paper core sandwiched between and bonded to inner and outer paper face liners.

According to the prior art, any kind of box is produced from one or more specific blanks of corrugated cardboard in dependence on the intended use and distribution channel. Hence, the present trends towards multiple formats, smaller volumes and customization dramatically increase the burden on production lines for adapting to such different requirements.

One object of the present invention is thus reducing the burden imposed by such articulated and various requirements on the production lines.

SUMMARY OF THE INVENTION

According to the present invention, this object is achieved by means of a blank comprising:

- a chassis of corrugated cardboard having a series of four first parallel crease lines, and a second and a third crease line intersecting said four first parallel crease lines, wherein said first, second and third crease lines individuate a series of a quadrangular closure flap, a quadrangular cover panel, a first quadrangular lateral panel, a quadrangular bottom panel and a second quadrangular lateral panel, wherein said second crease line individuates a respective left quadrangular flap of each panel and wherein said third crease line individuates a respective right quadrangular flap of each panel, each flap being separated from the adjacent flaps by cuts which extend along a prolongation of the respective first crease line,
- two compression members of corrugated cardboard glued to an internal face of the chassis in correspondence of areas at least bordering on both sides at least a part of a respective length of the second crease line joining the first and second quadrangular lateral panel to the respective left flap, and
- two compression members of corrugated cardboard glued to the internal face of the chassis in correspondence of areas at least bordering on both sides at least a part of a respective length of the third crease line joining the first and second quadrangular lateral panel to the respective right flap.

A further subject-matter of the present invention is constituted by a box obtainable from the above-disclosed blank by:

- folding the first and second lateral panels at 90° about the respective first crease line contiguous to the bottom panel, so as a first couple of opposite box side faces is formed,
- folding the flaps of the first and second lateral panels at 90° about the respective lengths of the second and third crease lines, so that a second couple of opposite box side faces is formed,
- folding the flaps of the bottom panel at 90° about the respective lengths of the second and third crease lines, so that the flaps of the bottom panel are arranged parallel and externally to said flaps of the first and second lateral panels,
- folding the cover panel at 90° about the first crease line contiguous to the adjacent lateral panel,
- folding the flaps of the cover panel at 90° about the respective lengths of the second and third crease lines, so that the flaps of the cover panel are arranged parallel and externally to said flaps of the first and second lateral panels, and
- folding the closure flap at 90° about the respective first crease line contiguous to the cover panel, so that said closure flap is arranged parallel and externally to said second lateral panel, wherein each corner of the box is internally reinforced by a compression member.

According to the invention, by changing size and marginal features of the standardized blank, whose basic structure remains unchanged, it is possible to produce different boxes satisfying quite different requirements.

According to the present invention, the performance of the used cardboard is optimized by using strengthening members where they are most needed and thus lightening the general structure of the box, which is thus fundamentally different from the conventional one due to the significant increase in performance.

The strength-conferring material is allocated only where it is absolutely needed: in particular, the chassis weight is decreased, because an high amount of fiber is not needed in the flaps, and the purpose of the chassis is essentially just to wrap around the articles within the box, so that the quantity of fiber is dramatically lower in comparison with conventional chassis. Such a reduction is rendered possible by the use of the compression members which confer the required strength.

According to the prior art, the final box is produced from a blank or chassis, in the entirety of which the quantity of fiber and the board grade are adapted to the performances required for the intended application.

On the contrary, according to the present invention, the manufacturing of chassis of different board grades is avoided and the chassis can be produced with the lightest weight, whereas the satisfaction of different requirements is allowed by selection of the proper size of the compression members.

For example, a box according to the invention has a total grammage of 99 g of fiber and is suitable for containing a load of 149 kg, with a reduction in fiber weight of 29% in respect of a conventional box realizing the same performance.

The gist of the present invention thus resides in the presence of the compression members, whose size can vary and provide the flexibility necessary for adapting to the different requirements with the lowest possible weight obtainable today on a corrugator.

BRIEF DESCRIPTION OF THE FIGURES

Further advantages and features of the present invention will be apparent from the following detailed description, given by way of non-limiting example with reference to the appended drawings, in which.

DETAILED DESCRIPTION

Figure 1:
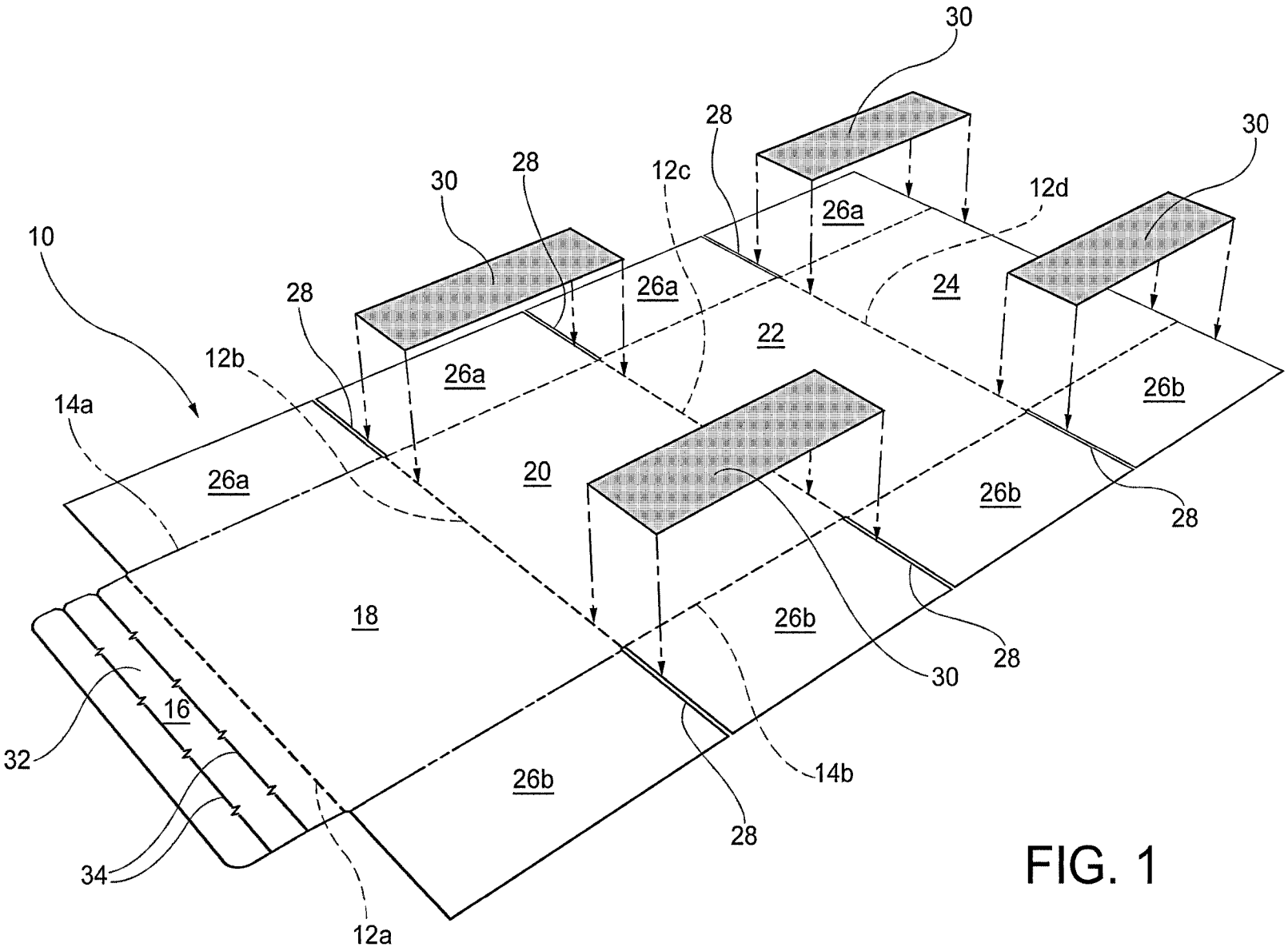
FIG. 1 is an exploded perspective view of a blank according to the invention.

A blank (see FIGS. 1 and 2) comprises a chassis 10 of corrugated cardboard and four compression members 30 of corrugated cardboard which can be of the same or different kind as the cardboard of the chassis 10. The flutes of the cardboard of the compression members 30 may be substantially orthogonal or parallel to the flutes of the cardboard of the chassis 10.

The chassis 10 has a series of four first parallel crease lines 12*a-d,* and a second and a third crease line 14*a,* 14*b* intersecting the four first parallel crease lines 12*a-d.*

The first, second and third crease lines 12*a-d,* 14*a,* 14*b* individuate a series of a quadrangular closure flap 16, a quadrangular cover panel 18, a first quadrangular lateral panel 20, a quadrangular bottom panel 22 and a second quadrangular lateral panel 24. The closure flap 16 has a median portion formed by a strip 32 separated by the adjacent end portions by respective pre-perforated detachment lines 34.

Furthermore, the second crease line 14*a* individuates a respective left quadrangular flap 26*a* of each panel 18, 20, 22, 24 and the third crease line 14*b* individuates a respective right quadrangular flap 26*b* of each panel 18, 20, 22, 24. Each flap 26*a,* 26*b* is separated from the adjacent flaps 26*a,* 26*b* by cuts 28 which extend along a prolongation of the respective first crease line 12*b-d.* The width of the flaps 26*a,* 26*b* is preferably about half of the length of the second and third crease lines 14*a,* 14*b* defining the bottom panel 22.

Figure 2:
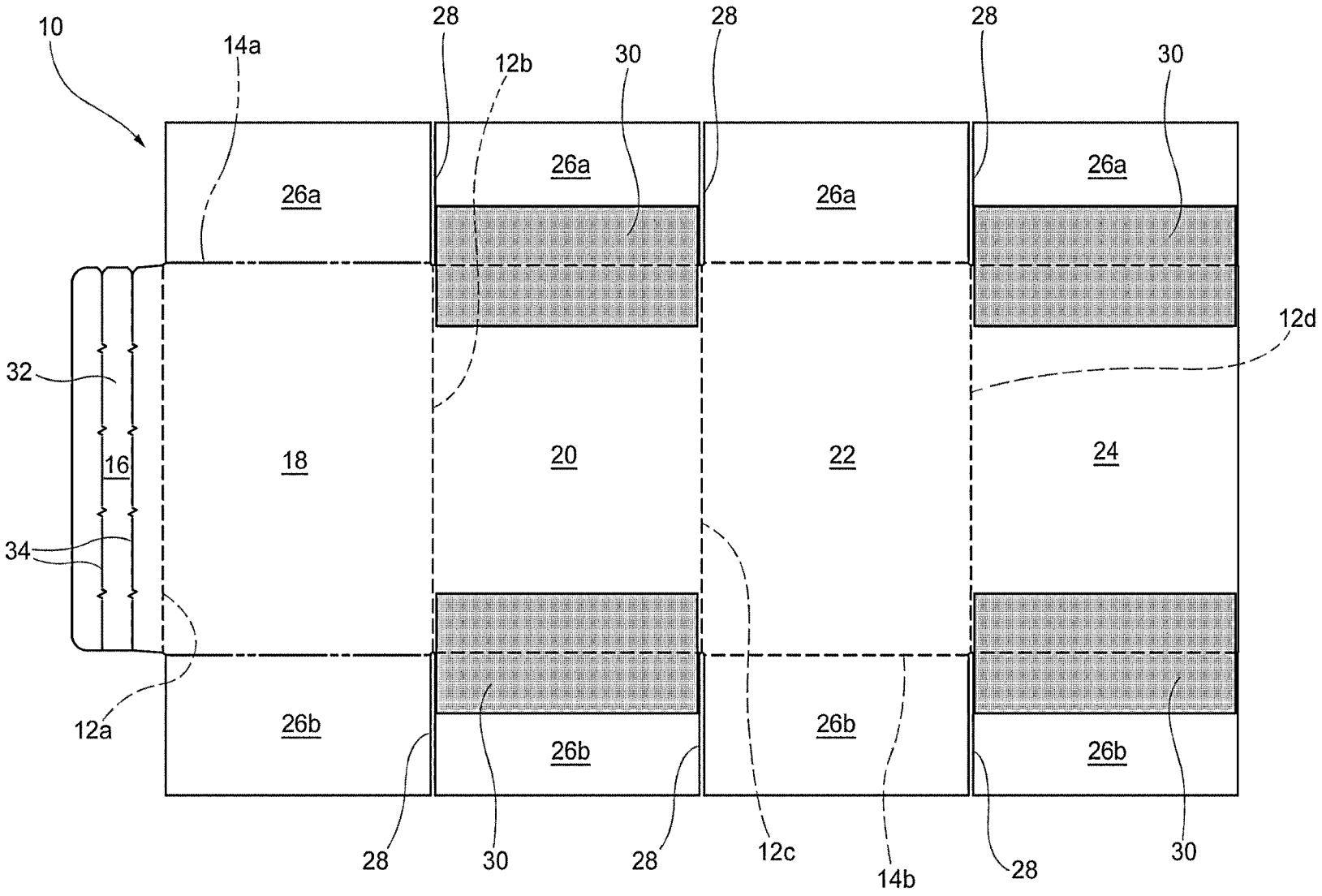
FIG. 2 is a plan view of the blank of FIG. 1.

As shown by FIG. 2, the second and third crease lines 14*a,* 14*b* are orthogonal to the four first parallel crease lines 12*a-d* and parallel to each other, so that the panels 18, 20, 22, 24 are substantially rectangular, including the particular case of "square".

Figure 3:
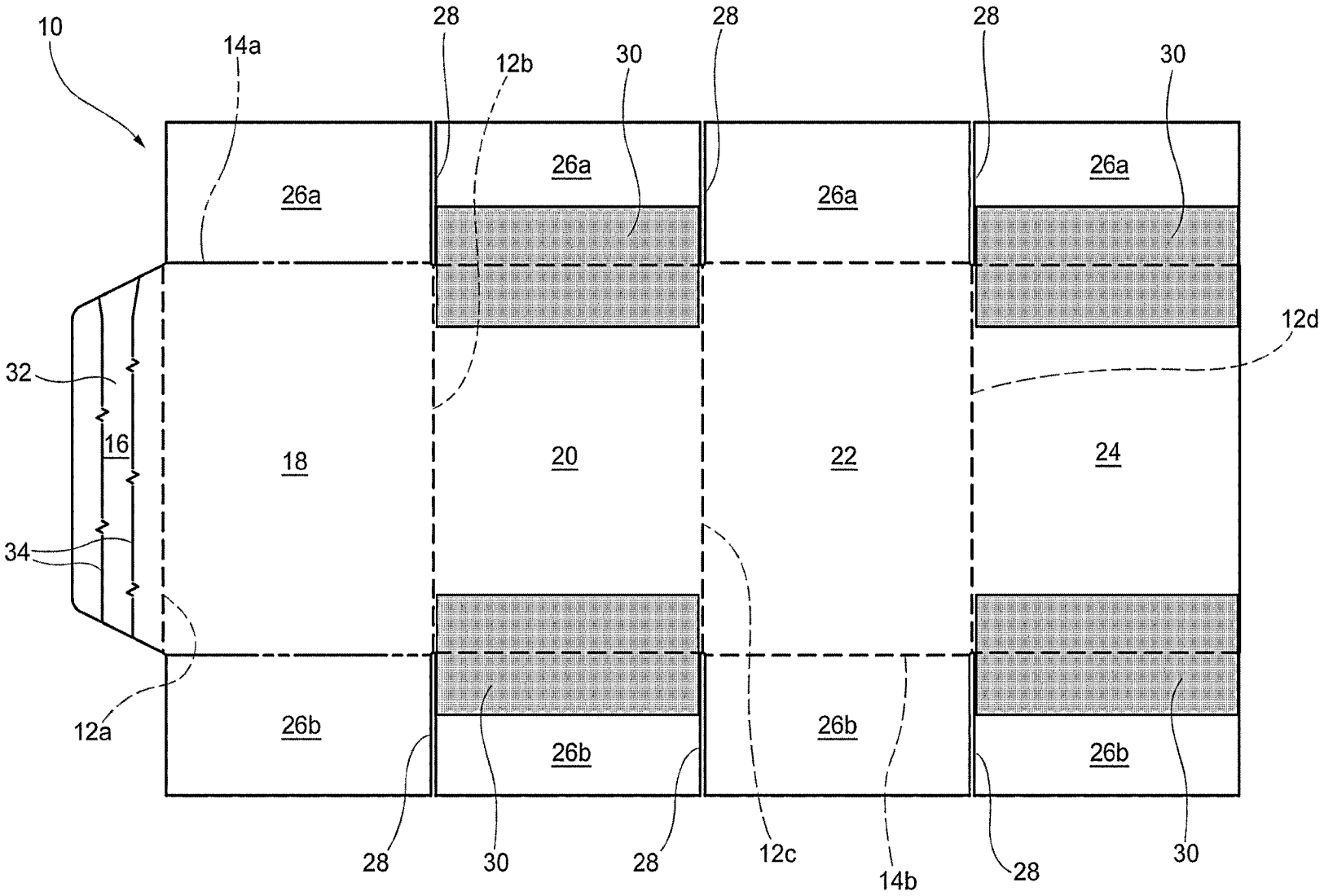
FIG. 3 is a plan view of a second embodiment of a blank according to the invention.

FIG. 3 shows a different embodiment of the chassis 10, wherein the second and third crease lines 14*a,* 14*b* are slightly inclined and intersect the four first parallel crease lines 12*a-d* at an angle slightly lower than 90°, e.g. until 85°. The other features of the chassis of FIG. 3 are the same as the ones of the chassis of FIG. 2 and indicated by the same reference numbers.

Two compression members 30 (see FIGS. 1 and 2) are glued to an internal face of the chassis 10 in correspondence of areas at least bordering on both sides at least a part of a respective length of the second crease line 14*a* joining the first and second quadrangular lateral panel 20, 24 to the respective left flap 26*a*. Likewise, two compression members 30 are glued to the internal face of the chassis 10 in correspondence of areas at least bordering on both sides at least a part of a respective length of the third crease line 14*b* joining the first and second quadrangular lateral panel 20, 24 to the respective right flap 26*b*.

A box (see FIG. 5), in particular a retail shipper, is obtained from the previously disclosed blank by substantially conventional automatized methods of folding, possibly providing also for using, if necessary, glue and/or adhesive tape.

In particular, one of such methods provides for:

- folding the first and second lateral panels 20, 24 at 90° about the respective first crease line 12*c,* 12*d* contiguous to the bottom panel 22, so as a first couple of opposite box side faces is formed,
- folding the flaps 26*a,* 26*b* of the first and second lateral panels 20, 24 at 90° about the respective lengths of the second and third crease lines 14*a,* 14*b,* so that a second couple of opposite box side faces is formed,
- folding the flaps 26*a,* 26*b* of the bottom panel 22 at 90° about the respective lengths of the second and third crease lines 14*a,* 14*b,* so that the flaps 26*a,* 26*b* of the bottom panel 22 are arranged parallel and externally to the flaps 26*a,* 26*b* of the first and second lateral panels 20, 24,
- folding the cover panel 18 at 90° about the first crease line 12*b* contiguous to the adjacent lateral panel 20,
- folding the flaps 26*a,* 26*b* of the cover panel 18 at 90° about the respective lengths of the second and third crease lines 14*a,* 14*b,* so that the flaps 26*a,* 26*b* of the cover panel 18 are arranged parallel and externally to the flaps 26*a,* 26*b* of the first and second lateral panels 20, 24, and
- folding the closure flap 16 at 90° about the respective first crease line 12*a* contiguous to the cover panel 18, so that the closure flap 16 is arranged parallel and externally to the second lateral panel 24.

Figure 5:
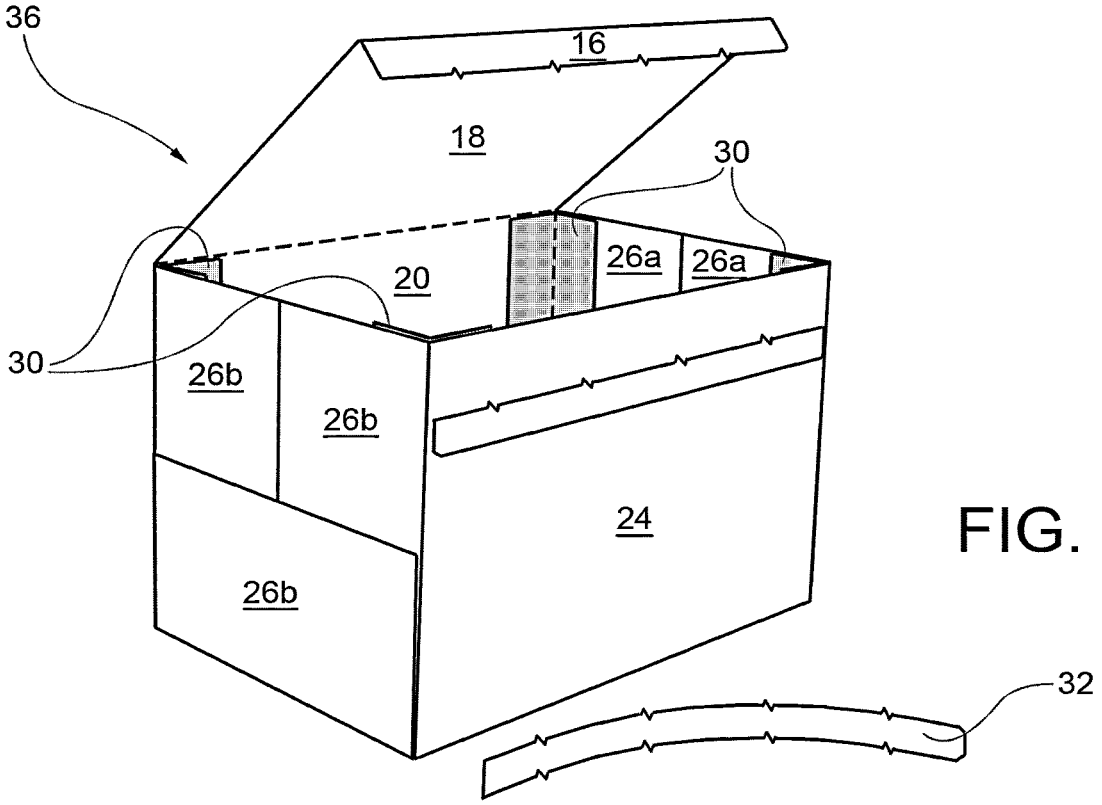
FIG. 5 is a perspective view in open configuration of a box obtained from the blank of FIG. 1.

As it is apparent from FIG. 5, each corner of the box 36 is internally reinforced by a compression member 30.

Figure 6:
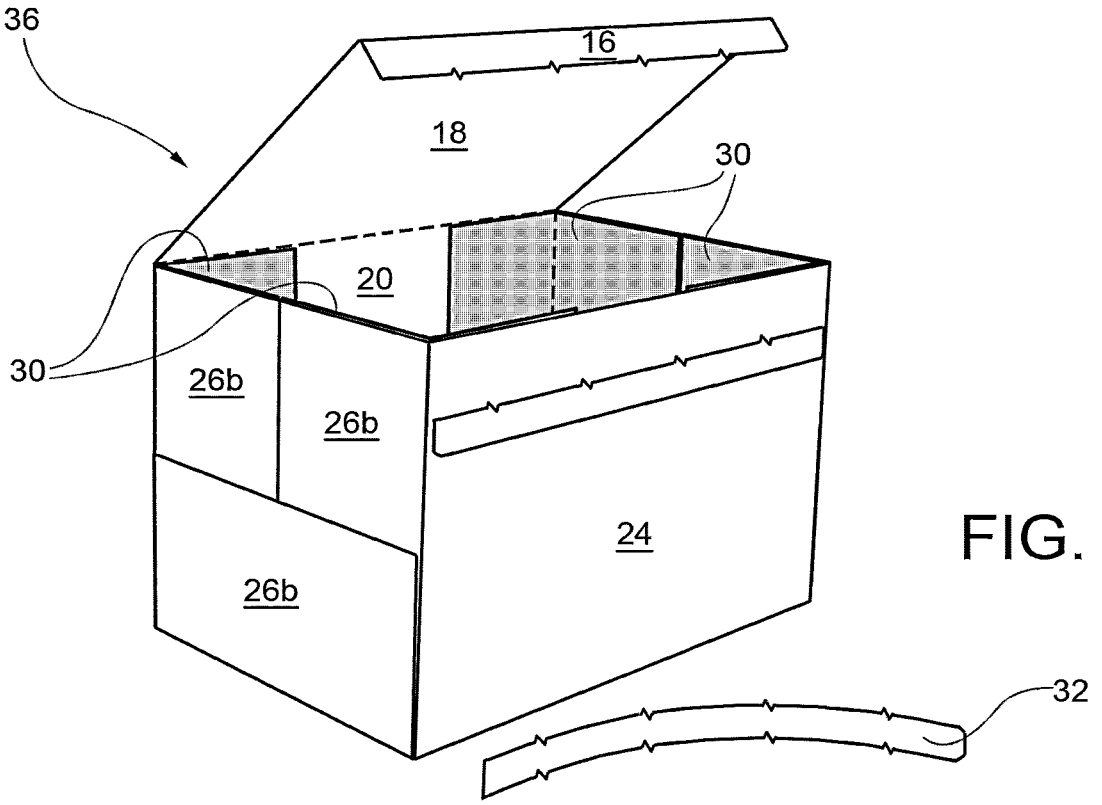
FIG. 6 is a perspective view in open configuration of a further embodiment of box according to the invention.

FIG. 6 shows a different embodiment of box 36, which is an e-com shipper. In this latter embodiment, the compression members 30 have a greater size, so that they reinforce the second couple of opposite box side faces for the entire extension thereof. Furthermore, the flutes of the chassis 10 may be so oriented that they lie horizontally in the erected configuration of the panels 24, 20, whereas they may lie vertically in the erected configuration of the box of FIG. 5. The other features of the boxes of FIGS. 5 and 6 are substantially the same.

Figure 4:
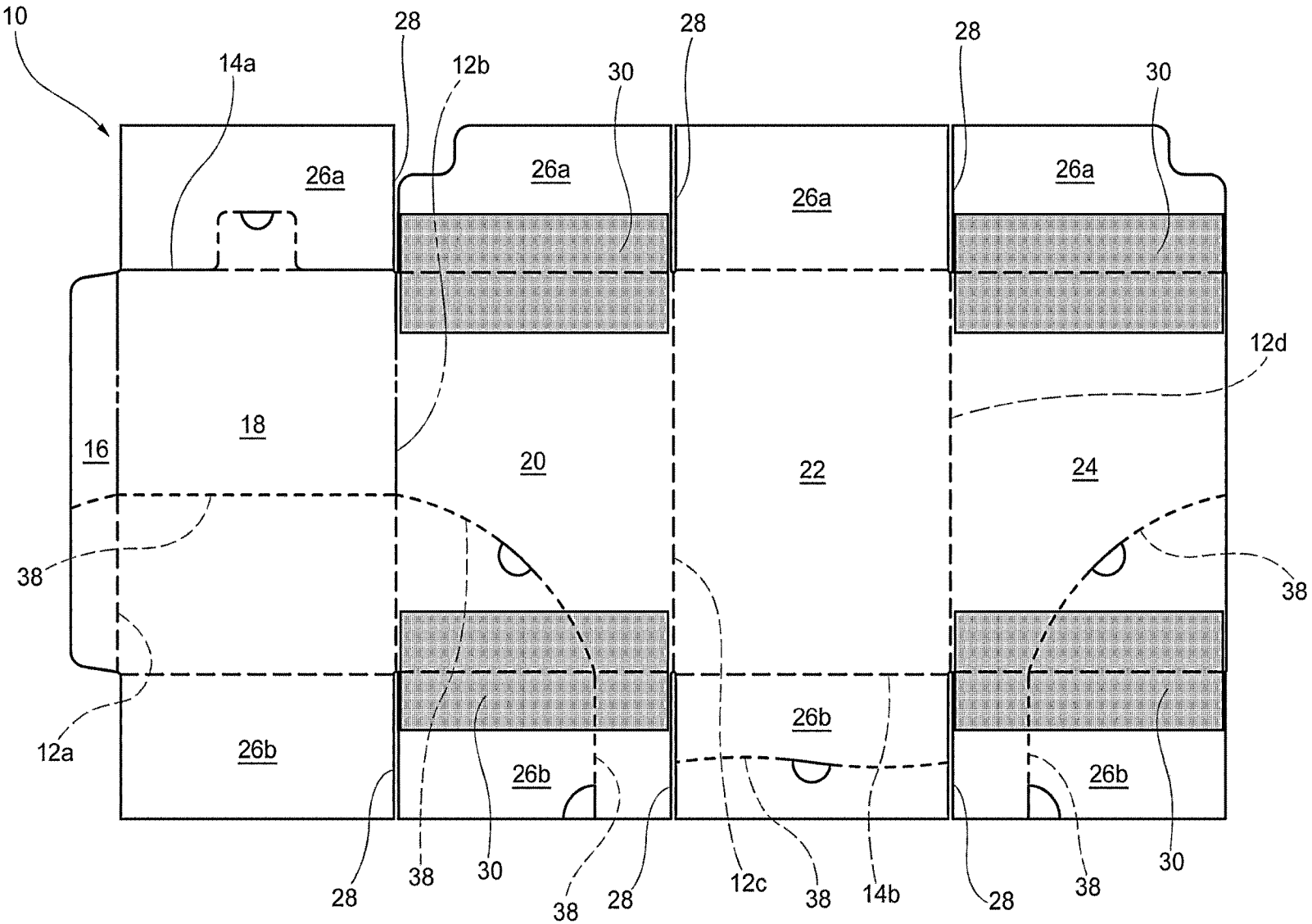
FIG. 4 is a plan view of a third embodiment of a blank according to the invention.
Figure 7:
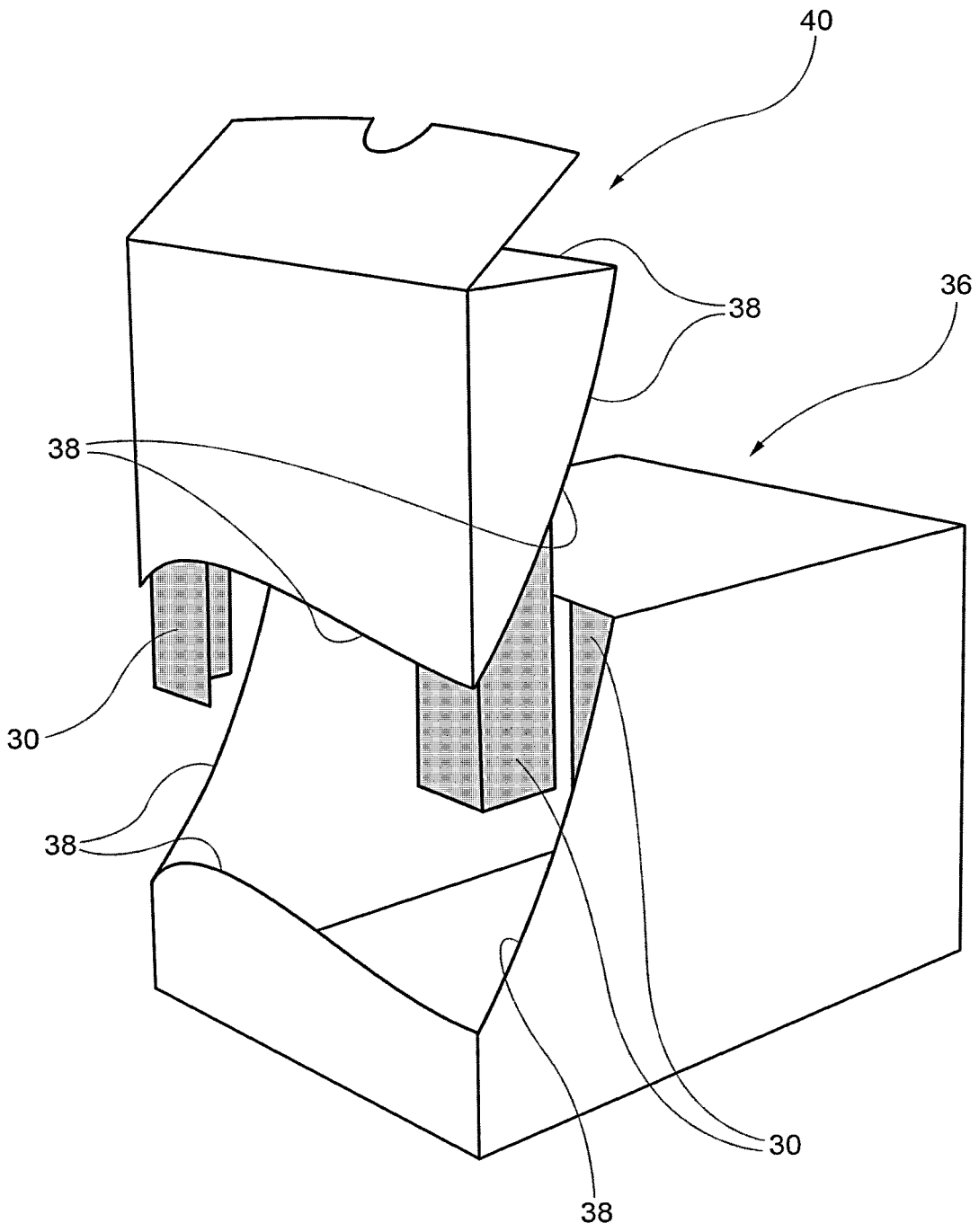
FIG. 7 is a perspective view in open configuration of a box obtained from the blank of FIG. 4.

FIGS. 4 and 7 illustrate a further embodiment of blank and box, respectively, wherein features equal or equivalent to the ones disclosed with reference to the embodiments of the previous figures have the same reference number.

In this embodiment, the chassis has pre-perforated detachment lines 38 and the box 36 is a shelf ready container having a removable portion 42 delimited by these pre-perforated detachment lines on the cover panel, the lateral panels and a front part of the box 36.

As it is apparent from FIG. 7, the compression members 30 reinforcing the front corners of the box are glued solely to the removable portion 40, so that they are removed together with this latter and do not hinder the access of the public to the articles within the box 36. It has to be emphasized that the portion 40 is quick and easy to remove and also to knock-flat after removal Accordingly, such latter embodiment constitutes further evidence of the versatility offered by the box structure of the present invention.

Naturally, the principles of the invention remaining the same, the details of construction and embodiments may be widely varied with respect to those described purely by way of example, without thereby departing from the claimed scope.

What is claimed is:

1. A blank comprising:

a chassis of corrugated cardboard having a series of four first parallel crease lines, a second crease line and a third crease line intersecting said four first parallel crease lines, wherein said first, second and third crease lines individuate a series of a quadrangular closure flap, a quadrangular cover panel, a first quadrangular lateral panel, a quadrangular bottom panel and a second quadrangular lateral panel, wherein said second crease line individuates a respective left quadrangular flap of each panel and wherein said third crease line individuates a respective right quadrangular flap of each panel, each flap being separated from adjacent flaps by cuts which extend along a prolongation of the respective first crease line, two compression members of corrugated cardboard, defined by two flat surfaces, where one of the flat surfaces is glued to an internal face of the chassis in correspondence of areas at least bordering on both sides at least a part of a respective length of the second crease line joining the first and second quadrangular lateral panels to the respective left quadrangular flap, and two compression members of corrugated cardboard, defined by two flat surfaces, where one of the flat surfaces is glued to the internal face of the chassis in correspondence of areas at least bordering on both sides at least a part of a respective length of the third crease line joining the first and second quadrangular lateral panels to the respective right quadrangular flap.

2. The blank of claim 1, wherein said second and third crease lines intersect said four first parallel crease lines at an angle ranging from 90° to 85°.

3. The blank of claim 1, wherein flutes of said compression members are substantially parallel to flutes of said chassis.

4. The blank of claim 1, wherein flutes of said compression members are substantially orthogonal to flutes of said chassis.

5. The blank of claim 1, wherein a width of said flaps is about half of the length of the second and third crease lines defining said bottom panel.

6. The blank of claim 1, wherein the corrugated cardboard of the chassis and of the compression members is of the same kind.

7. The blank of claim 1, wherein said closure flap has a median portion formed by a strip separated by adjacent end portions by respective pre-perforated detachment lines.

8. The blank of claim 1, wherein the second and third crease lines are orthogonal to the four first parallel crease lines.

9. A box obtainable from a blank comprising:

a chassis of corrugated cardboard having a series of four first parallel crease lines, a second crease line and a third crease line intersecting said four first parallel crease lines, wherein said first, second and third crease lines individuate a series of a quadrangular closure flap, a quadrangular cover panel, a first quadrangular lateral panel, a quadrangular bottom panel and a second quadrangular lateral panel, wherein said second crease line individuates a respective left quadrangular flap of each panel and wherein said third crease line individuates a respective right quadrangular flap of each panel, each flap being separated from adjacent flaps by cuts which extend along a prolongation of the respective first crease line, two flat compression members of corrugated cardboard, defined by two flat surfaces, where one of the two flat surfaces is glued to an internal face of the chassis in correspondence of areas at least bordering on both sides at least a part of a respective length of the second crease line joining the first and second quadrangular lateral panels to the respective left quadrangular flap, and two flat compression members of corrugated cardboard, defined by two flat surfaces, where one of the two flat surfaces is glued to the internal face of the chassis in correspondence of areas at least bordering on both sides at least a part of a respective length of the third crease line joining the first and second quadrangular lateral panels to the respective right quadrangular, by:

folding the first and second quadrangular lateral panels at 90° about the respective first crease line contiguous to the bottom panel, so that a first couple of opposite box side faces is formed, folding the flaps of the first and second quadrangular lateral panels with the respective compression members at 90° about the respective lengths of the second and third crease lines, so that a second couple of opposite box side faces is formed, folding the flaps of the bottom panel at 90° about the respective lengths of the second and third crease lines, so that the flaps of the bottom panel are arranged parallel and externally to said flaps of the first and second quadrangular lateral panels, folding the cover panel at 90° about the first crease line contiguous to the first quadrangular lateral panel, folding the flaps of the cover panel at 90° about the respective lengths of the second and third crease lines, so that the flaps of the cover panel are arranged parallel and externally to said flaps of the first and second quadrangular lateral panels, and folding the closure flap at 90° about the respective first crease line contiguous to the cover panel, so that said closure flap is arranged parallel and externally to said second quadrangular lateral panel, wherein each corner of the box is internally reinforced by a compression member.

10. The box of claim 9, wherein the box is selected from the group consisting of retail shipper, e-com shipper and shelf ready container.

11. The box of claim 10, wherein the box is a shelf ready container having a removable portion delimited by respective pre-perforated detachment lines on the cover panel, the first and second quadrangular lateral panels and a front part.

12. The box of claim 11, wherein the compression members reinforcing front corners of the box are glued solely to said removable portion.

* * * * *